US008839887B2

(12) United States Patent
Xia et al.

(10) Patent No.: US 8,839,887 B2
(45) Date of Patent: Sep. 23, 2014

(54) COMPOSITE SINTERED CARBIDES

(75) Inventors: Sike Xia, Pearland, TX (US); Zhou Yong, Spring, TX (US)

(73) Assignee: Smith International, Inc., Houston, TX (US)

( * ) Notice: Subject to any disclaimer, the term of this patent is extended or adjusted under 35 U.S.C. 154(b) by 503 days.

(21) Appl. No.: 12/723,082

(22) Filed: Mar. 12, 2010

(65) Prior Publication Data

US 2010/0230173 A1 Sep. 16, 2010

Related U.S. Application Data

(60) Provisional application No. 61/159,980, filed on Mar. 13, 2009.

(51) Int. Cl.

| | |
|---|---|
| ***E21B 10/46*** | (2006.01) |
| ***C22C 29/06*** | (2006.01) |
| ***E21B 10/50*** | (2006.01) |
| ***E21B 17/10*** | (2006.01) |
| *C22C 29/08* | (2006.01) |

(52) U.S. Cl.

CPC ..... *C22C 29/06* (2013.01); *B22F 2999/00* (2013.01); *C22C 29/08* (2013.01); *E21B 10/50* (2013.01); *E21B 17/1085* (2013.01)

USPC ..... 175/425

(58) Field of Classification Search

USPC ..... 175/425, 435; 75/236

See application file for complete search history.

(56) References Cited

U.S. PATENT DOCUMENTS

| | | | | |
|---|---|---|---|---|
| 3,800,891 | A * | 4/1974 | White et al. | 175/374 |
| 4,024,902 | A * | 5/1977 | Baum | 164/97 |
| 4,420,441 | A | 12/1983 | Singer | |
| 4,499,795 | A * | 2/1985 | Radtke | 76/108.2 |
| 4,723,996 | A | 2/1988 | Brunet et al. | |
| 4,851,041 | A | 7/1989 | Polizzotti | |
| 5,089,182 | A | 2/1992 | Findeisen et al. | |
| 5,541,006 | A | 7/1996 | Conley | |
| 5,755,299 | A * | 5/1998 | Langford et al. | 175/375 |
| 5,880,382 | A * | 3/1999 | Fang et al. | 75/236 |
| 5,988,302 | A * | 11/1999 | Sreshta et al. | 175/374 |
| 6,908,688 | B1 | 6/2005 | Majagi et al. | |
| 2002/0198095 | A1 | 12/2002 | Mah | |
| 2007/0049484 | A1 | 3/2007 | Kear | |
| 2007/0056777 | A1 * | 3/2007 | Overstreet | 175/433 |
| 2007/0163812 | A1 * | 7/2007 | Overstreet et al. | 175/374 |
| 2008/0164070 | A1 | 7/2008 | Keshavan | |

FOREIGN PATENT DOCUMENTS

WO 2010105151 9/2010

OTHER PUBLICATIONS

International Search Report and Written Opinion of the International Searching Authority dated Nov. 1, 2010 for corresponding PCT application No. PCT/US2010/027133.

* cited by examiner

*Primary Examiner* — Cathleen Hutchins
*Assistant Examiner* — Ronald Runyan

(57) ABSTRACT

A carbide composite material that includes a continuous ductile phase; and at least one discrete carbide region surrounded by the continuous ductile phase, each discrete carbide region may comprise an integrally bridged plurality of cast and/or sintered carbide particles, and each discrete region may have a nodular particle morphology.

30 Claims, 8 Drawing Sheets

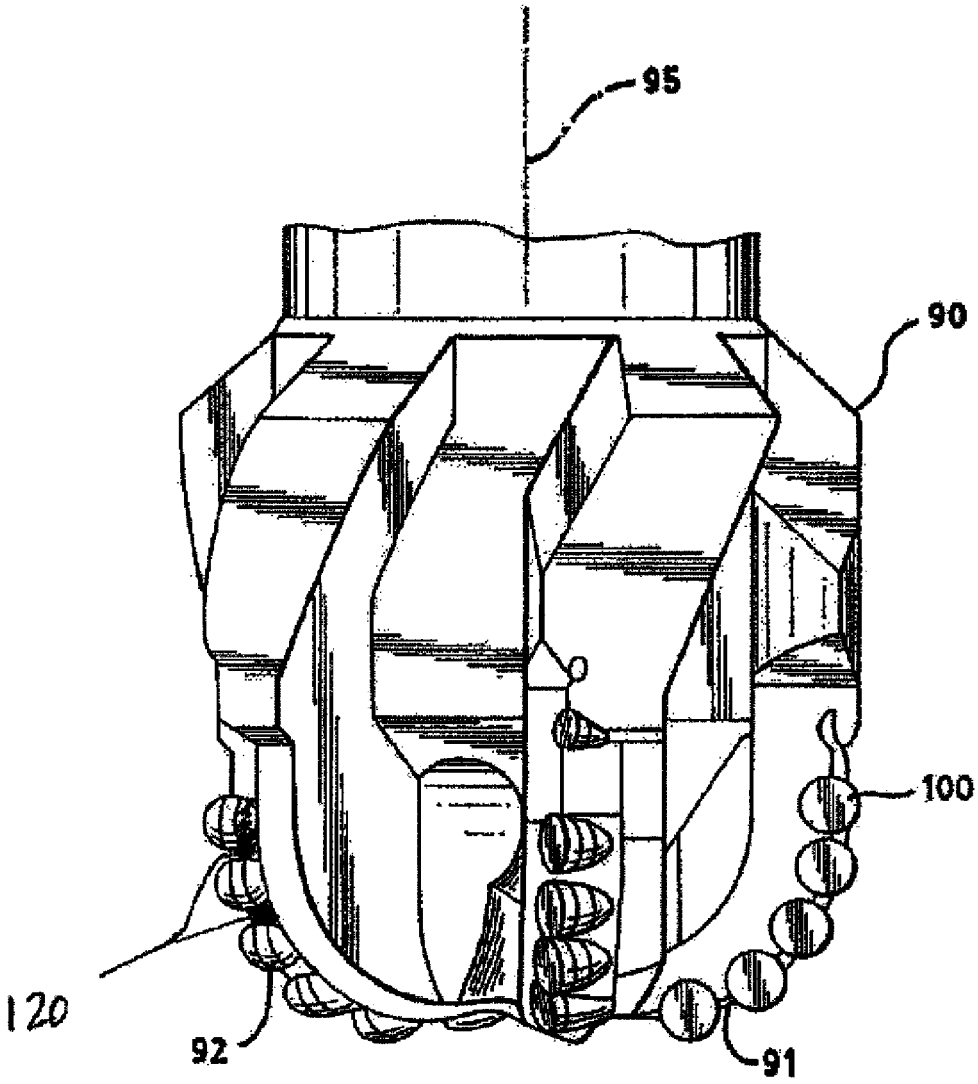
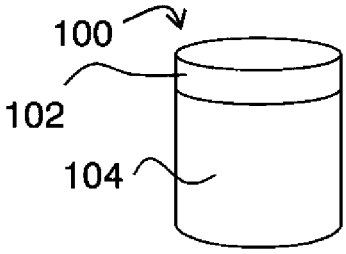
FIG. 12

COMPOSITE SINTERED CARBIDES

CROSS-REFERENCE TO RELATED APPLICATIONS

This application claims priority to U.S. Provisional Application No. 61/159,980, filed Mar. 13, 2009, which is hereby incorporated by reference in its entirety.

BACKGROUND OF INVENTION

1. Field of the Invention

Embodiments disclosed herein relate generally to carbide composite materials. In particular, embodiments disclosed herein relate to carbide composite materials for use in hardfacing materials or other cutting tool components.

2. Background Art

In drilling oil and gas wells or mineral mines, earth-boring drill bits are commonly used. Typically, an earth-boring drill bit is mounted on the lower end of a drill string and is rotated by rotating the drill string at the surface. With weight applied to the drill string, the rotating drill bit engages an earthen formation and proceeds to form a borehole along a predetermined path toward a target zone.

Historically, there have been two types of drill bits used drilling earth formations, drag bits and roller cone bits. Roller cone bits include one or more roller cones rotatably mounted to the bit body. These roller cones have a plurality of cutting elements attached thereto that crush, gouge, and scrape rock at the bottom of a hole being drilled. Several types of roller cone drill bits are available for drilling wellbores through earth formations, including insert bits (e.g. tungsten carbide insert bit, TCI) and "milled tooth" bits. The bit bodies and roller cones of roller cone bits are conventionally made of steel. In a milled tooth bit, the cutting elements or teeth are steel and conventionally integrally formed with the cone. In an insert or TCI bit, the cutting elements or inserts are conventionally formed from tungsten carbide, and may optionally include a diamond enhanced tip thereon.

The term "drag bits" refers to those rotary drill bits with no moving elements. Drag bits are often used to drill a variety of rock formations. Drag bits include those having cutting elements or cutters attached to the bit body, which may be a steel bit body or a matrix bit body formed from a matrix material such as tungsten carbide surrounded by a binder material. The cutters may be formed having a substrate or support stud made of carbide, for example tungsten carbide, and an ultra hard cutting surface layer or "table" made of a polycrystalline diamond material or a polycrystalline boron nitride material deposited onto or otherwise bonded to the substrate at an interface surface.

Typically, a hardfacing material is applied, such as by arc or gas welding, to the exterior surface of the steel components (e.g., milled teeth or steel bit body) to improve the wear resistance of the area of the bit (or other downhole tools needing body protection). The hardfacing material typically includes one or more metal carbides, which are bonded to the steel components by a metal alloy ("binder alloy"). In effect, the carbide particles are suspended in a matrix of metal forming a layer on the surface of the steel. The carbide particles give the hardfacing material hardness and wear resistance, while the matrix metal provides fracture toughness to the hardfacing.

Many factors affect the durability of a hardfacing composite or other carbide component such as cutting elements in a particular application. These factors include the chemical composition and physical structure (size and shape) of the carbides, the chemical composition and microstructure of the matrix metal or alloy, and the relative proportions of the carbide materials to one another and to the matrix metal or alloy. The metal carbide most commonly used in hardfacing and cutting elements is tungsten carbide. Small amounts of tantalum carbide and titanium carbide may also be present in such material, although these other carbides may be considered to be deleterious.

Many different types of tungsten carbides are known based on their different chemical compositions and physical structure. The types of tungsten carbide commonly typically used in hardfacing and cutting elements are cast tungsten carbide, macro-crystalline tungsten carbide, carburized tungsten carbide, and cemented tungsten carbide (also known as sintered tungsten carbide).

Tungsten forms two carbides, monotungsten carbide (WC) and ditungsten carbide ($W_2C$). Tungsten carbide may also exist as a mixture of these two forms with any proportion between the two. Cast carbide is a eutectic mixture of the WC and $W_2C$ compounds, and as such the carbon content in cast carbide is sub-stoichiometric, i.e., it has less carbon than the more desirable WC form of tungsten carbide. Cast carbide is prepared by freezing carbide from a molten state and may be subjected to crushing and comminuting to form the resultant particles of the desired particle size.

Macro-crystalline tungsten carbide is essentially stoichiometric WC in the form of single crystals. While most of the macro-crystalline tungsten carbide is in the form of single crystals, some bicrystals of WC are found in larger particles. Macro-crystalline WC is a desirable hardfacing material because of its toughness and stability.

The third type of tungsten carbide used in hardfacing is cemented tungsten carbide, also known as sintered tungsten carbide. Cemented tungsten carbide comprises small particles of tungsten carbide (e.g., 1 to 15 microns) bonded together with a binder metal. Cemented tungsten carbide is made by mixing organic wax, tungsten carbide, typically monotungsten carbide, and cobalt or other iron group metal powders, pressing the mixed powders to form a green compact, and "sintering" the composite at temperatures near the melting point of cobalt. The resulting dense cemented carbide can then be crushed and comminuted to form particles of cemented tungsten carbide for use in hardfacing. Cemented tungsten carbide, such as WC—Co, is well known for its mechanical properties of hardness, toughness and wear resistance, making it a popular material of choice for use in such industrial applications as mining and drilling where its mechanical properties are highly desired. Because of its desired properties, cemented tungsten carbide has been the dominant material used as cutting tools for machining, hardfacing, wear inserts, and cutting inserts in rotary cone rock bits, and substrate bodies for drag bit shear cutters. The mechanical properties associated with cemented tungsten carbide and other cermets, especially the unique combination of hardness, toughness, and wear resistance, make these materials more desirable than either metals or ceramics alone.

Carburized carbide is yet another type of tungsten carbide. Carburized tungsten carbide is a product of the solid-state diffusion of carbon into tungsten metal at high temperatures in a protective atmosphere. Sometimes, it is referred to as fully carburized tungsten carbide. Such carburized tungsten carbide particles usually are multi-crystalline, i.e., they are composed of tungsten carbide agglomerates. Typical carburized tungsten carbide contains a minimum of 99.8% by weight of tungsten carbide, with total carbon content in the range of about 6.08% to about 6.18% by weight.

Regardless of the type of material used, designers continue to seek improved properties (such as improved wear resistance, toughness, thermal resistance, etc.) in all carbide composites.

SUMMARY OF INVENTION

In one aspect, embodiments disclosed herein relate to a carbide composite material that includes a continuous ductile phase; and at least one discrete carbide region surrounded by the continuous ductile phase, each discrete carbide region comprising an integrally bridged plurality of cast and/or sintered carbide particles, and each discrete region having a nodular particle morphology.

In another aspect, embodiments disclosed herein relate to a carbide composite material that includes a first continuous ductile phase; and a plurality of first discrete regions, each first discrete region comprising: a second continuous ductile phase; and at least one second discrete carbide region surrounded by the second continuous ductile phase, each second discrete carbide region comprising an integrally bridged plurality of cast and/or sintered carbide particles, and each discrete carbide region having a nodular particle morphology.

In another aspect, embodiments disclosed herein relate to a carbide composite material that includes a first continuous ductile phase; and a plurality of first discrete regions, each first discrete region comprising: a second continuous ductile phase; and a plurality of first carbide particles surrounded by the second continuous ductile phase, the plurality of first carbide particles selected from at least one of cast carbide or sintered carbide.

In yet another aspect, embodiments disclosed herein relate to a drill bit that includes a bit body; and at least one cutting element; a hardfacing comprising a carbide composite material disposed on at least an exterior portion of the drill bit, wherein the carbide composite includes a continuous ductile phase; and at least one discrete carbide region surrounded by the continuous ductile phase, each discrete carbide region comprising an integrally bridged plurality of cast and/or sintered carbide particles, and each discrete region having a nodular particle morphology.

In yet another aspect, embodiments disclosed herein relate to a drill bit that includes a bit body; and at least one cutting element; a hardfacing comprising a carbide composite material disposed on at least an exterior portion of the drill bit, wherein the carbide composite includes a first continuous ductile phase; and a plurality of first discrete regions, each first discrete region comprising: a second continuous ductile phase; and at least one second discrete carbide region surrounded by the second continuous ductile phase, each second discrete carbide region comprising an integrally bridged plurality of cast and/or sintered carbide particles, and each discrete carbide region having a nodular particle morphology.

In yet another aspect, embodiments disclosed herein relate to a drill bit that includes a bit body; and at least one cutting element; a hardfacing comprising a carbide composite material disposed on at least an exterior portion of the drill bit, wherein the carbide composite includes a first continuous ductile phase; and a plurality of first discrete regions, each first discrete region comprising: a second continuous ductile phase; and a plurality of first carbide particles surrounded by the second continuous ductile phase, the plurality of first carbide particles selected from at least one of cast carbide or sintered carbide.

In yet another aspect, embodiments disclosed herein relate to a drill bit that includes a bit body; and at least one cutting element, wherein the bit body comprises a carbide composite material, as disclosed in one or more embodiments herein.

In yet another aspect, embodiments disclosed herein relate to a drill bit that includes a bit body; and at least one cutting element, wherein the at least one cutting element comprises a carbide composite material, as disclosed in one or more embodiments herein.

Other aspects and advantages of the present disclosure will be apparent from the following description and the appended claims.

BRIEF DESCRIPTION OF DRAWINGS

FIG. 11 illustrates a fixed cutter bit that incorporates the composite materials of the present disclosure.

FIG. 12 illustrates a PDC cutter that may be formed with the composite materials of the present disclosure.

DETAILED DESCRIPTION

Embodiments disclosed herein are directed to carbide composite materials that contain carbide regions and a continuous ductile phase. The carbide composite materials disclosed herein may form various components of downhole cutting tools, including drill bits, mining picks, core bits, etc.

Figure 1:
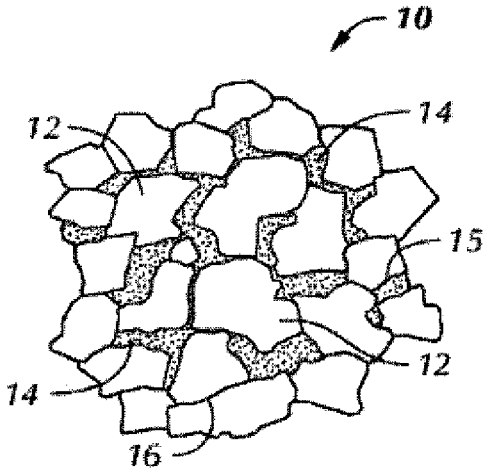
FIG. 1 illustrates a conventional microstructure of tungsten carbide/metal composite.

FIG. 1 illustrates the conventional microstructure of tungsten carbide/metal composite. As shown in FIG. 1, cemented tungsten carbide 24 includes tungsten carbide grains 12 that are bonded to one another by a metal binder phase 14. As illustrated, tungsten carbide grains may be bonded to other grains of tungsten carbide (depending on the metal content), thereby having a tungsten carbide/tungsten carbide interface 46, and/or may be bonded to the metal phase, thereby having a tungsten carbide/metal interface 45. The unique properties of tungsten carbide composites result from this combination of hard carbide particles with a tougher, ductile metal phase.

In conventional tungsten carbide/metal composites, it is possible to increase the toughness of the tungsten carbide composite by increasing the amount of metal binder present in the composite and/or by increasing the carbide grain size. As described above, in cutting tools, various portions thereof may be formed from carbide composites, including hardfacings (in which carbide particles are suspended in a steel or other metal alloy ductile phase), cutting elements (in which carbide particles are sintered with a metal binder to form a cermet material), and matrix bit bodies (in which carbide particles are infiltrated or otherwise cast with a molten metal alloy). While some discussion in the present application may discuss the use of the composite materials in hardfacing, the present application broadly relates to the composite materials themselves and may equally be applied to cutting elements or bit bodies, as would be recognized by those skilled in the art.

In hardfacings, specifically, in addition to striking an accord between carbide and metal content to balance adequate toughness and wear resistance, there may also be issues with non-uniform distribution and grouping of carbide within the ductile phase, and sinking of harder, heavier, and smaller particles, to also reduce the wear resistance of the hardfacing composite material. However, embodiments of the present disclosure relate to mechanisms by which the traditionally inversely related properties of wear resistance and toughness may instead be integrated and simultaneously increased.

Embodiments disclosed herein relate to the use of sintered tungsten carbide (WC—Co composite) and/or cast tungsten carbide (eutectic mixture of WC and $W_2C$) in carbide composite materials. Sintered carbides, which have larger particle size and are softer than cast carbides, may represent the largest volume of a carbide phase and may provide greater toughness. Cast carbides, on the other hand, are harder, heavier, and smaller in size and may particularly provide increased wear resistance to a hardfacing material. However, in conventional hardfacing applications, during the application of hardfacing, hard particles often group together or sink away from the exterior surface of the hardfacing. Thus, embodiments disclosed herein may attempt to better control distribution of wear resistant carbides through a composite material.

Additionally, also of concern in conventional hardfacings is the dissolution of sintered carbides, which can significantly reduce the wear resistance of the hardfacing. Dissolution can occur when sintered carbides are in direct contact with the matrix binder (e.g., a iron-based alloy). The binder may diffuse into the sintered carbide and dilute the binder of the sintered carbide. Thus, embodiments disclosed herein may also attempt to reduce dissolution of sintered carbides in a composite material.

Figure 2A:
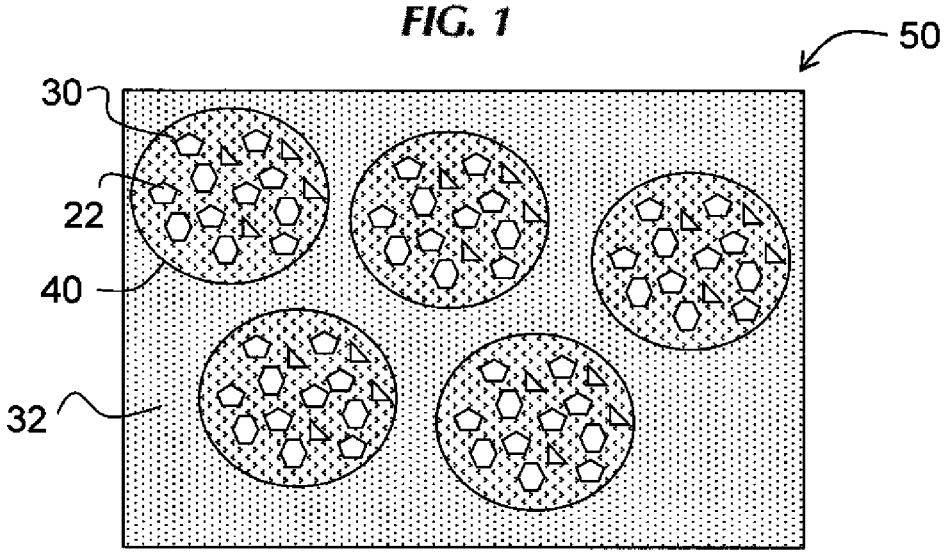
FIGS. 2A to 2C illustrate schematics of composite materials of the present disclosure that use cast carbide particles, sintered carbide particles, and combinations thereof.
Figure 2B:
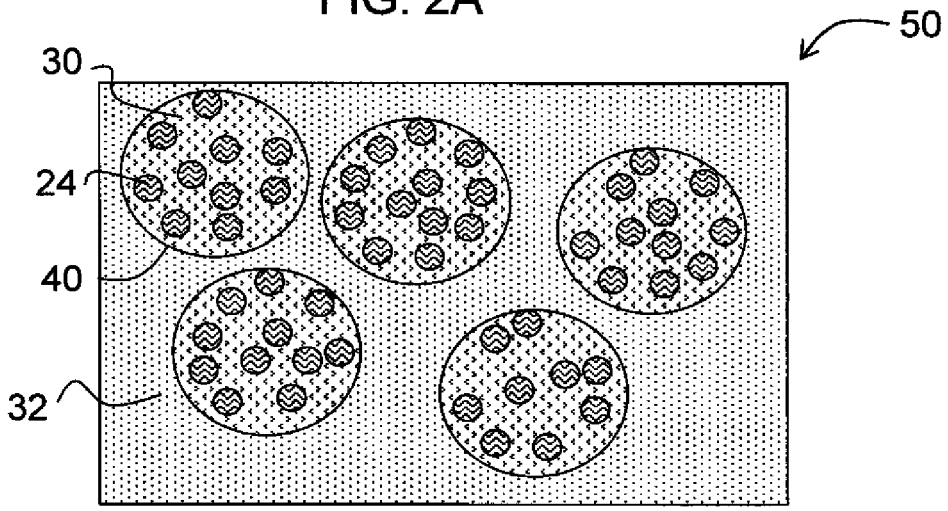
Figure 2C:
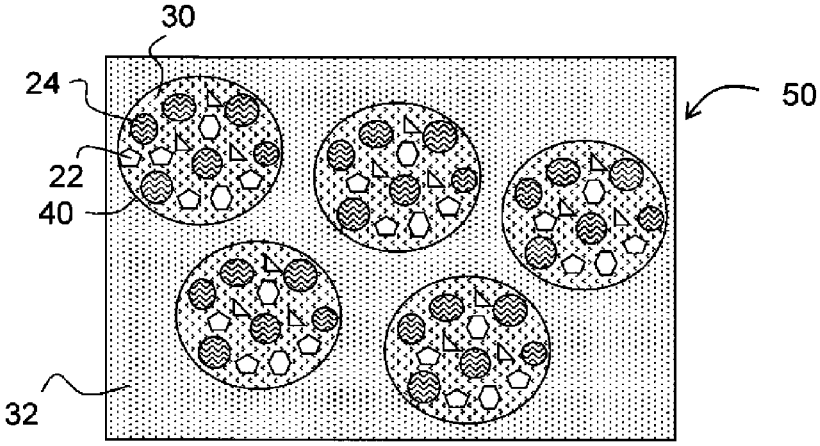

For example, some embodiments disclosed herein relate to the formation of sintered bodies (pellets or other shapes) of cast and/or sintered carbide particles that may then be used in combination with a ductile metal phase in various carbide composite applications. Such embodiments are illustrated in FIGS. 2A to 2C. As shown in FIGS. 2A to 2C, cast tungsten carbide particles 22 (shown in FIG. 2A), sintered tungsten carbide particles 24 (shown in FIG. 2B), or combinations of both (shown in FIG. 2C) may be combined with a ductile metal binder phase 30 and sintered to form discrete bodies or regions 40. Discrete bodies or regions 40 may then be used with a second ductile metal binder phase 32 to form composite material 50. While FIGS. 2A and 2C show angular cast carbides and spherical sintered carbides, the present disclosure is not so limited. Rather, it is within the scope of the present disclosure that cast carbides, as well as sintered carbides, may be angular or spherical. In a particular embodiment, angular cast carbides and spherical sintered carbides may be used in the various composite materials disclosed herein.

Such discrete bodies 40 may be formed in pellets (or other angular shaped bodies) that may be used as a hardfacing powder (in combination with a steel or other metal alloy binder) in, for example, a hardfacing rod; as a carbide powder that is combined with a metal binder and subjected to sintering conditions to form a cutting element such as a tungsten carbide insert for a roller cone bit or a substrate for a PDC cutter for a fixed cutter bit; or as a carbide powder that is either infiltrated or cast into a matrix bit body with a molten alloy. Thus, in each application, the discrete bodies 40 of cast and/or sintered carbide particles 22, 24 surrounded by a ductile phase 30 may be combined with another ductile material 32 to result in the final composite structure 50 (hardfacing, cutting element, bit body).

Figure 3A:
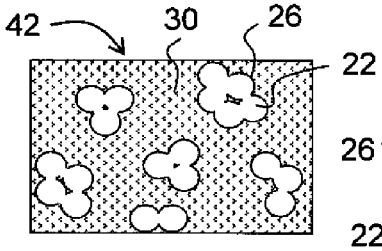
FIGS. 3A to 3C illustrate schematics of composite materials of the present disclosure that use cast carbide particles.
Figure 3B:
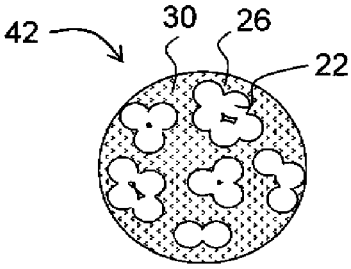
Figure 3C:
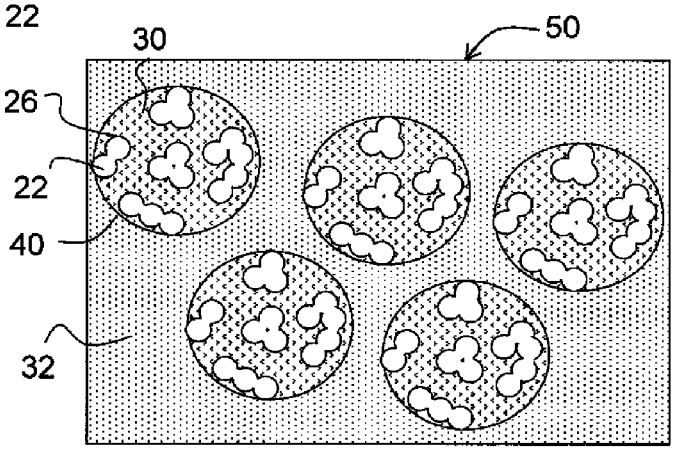
Figure 4A:
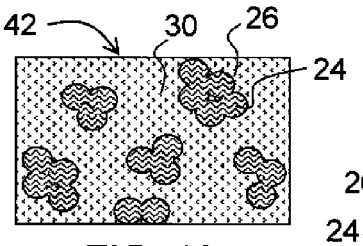
FIGS. 4A to 4C illustrate schematics of composite materials of the present disclosure that use sintered carbide particles.
Figure 4B:
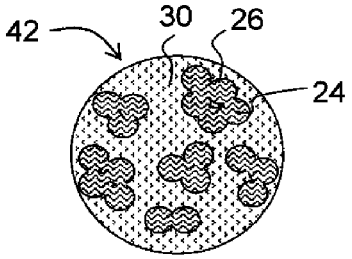
Figure 4C:
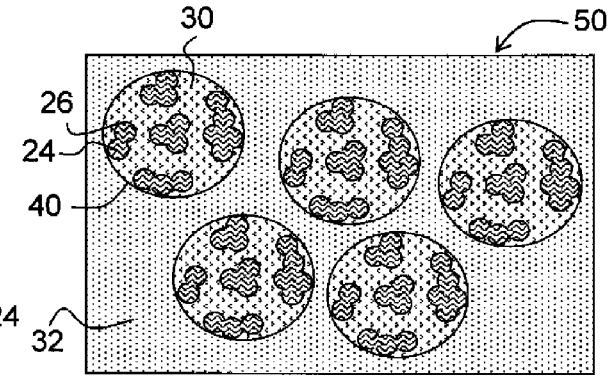
Figure 5A:
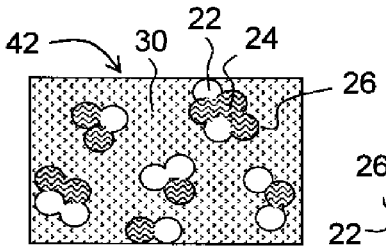
FIGS. 5A to 5C illustrate schematics of composite materials of the present disclosure that use combinations of cast carbide particles and sintered carbide particles.
Figure 5B:
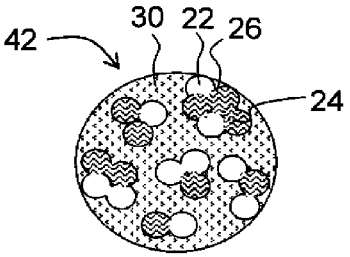
Figure 5C:
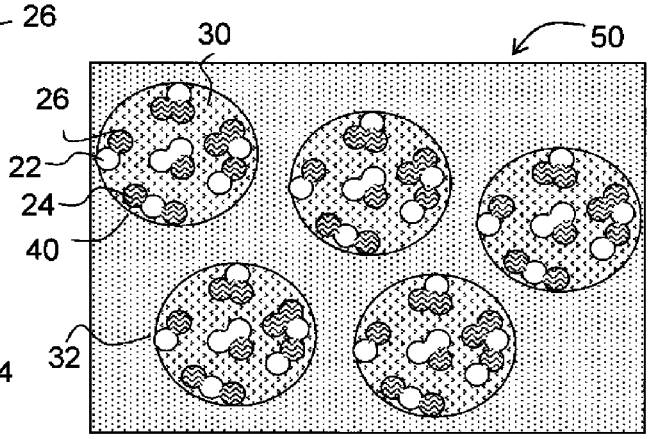

In addition to having the cast and/or sintered carbide particles be dispersed through a ductile phase (as shown in FIGS. 2A to 2C), some embodiments of the present disclosure are directed to clusters of said cast and/or sintered carbide particles. Referring to FIG. 3A to 5C, embodiments of composite materials that included clustered carbide particles are shown. Specifically, as shown in FIGS. 3C, 4C, and 5C, similar to FIGS. 2A to 2C, a composite material 50 includes discrete bodies 40 (of cast and/or sintered carbide particles 22, 24 surrounded by a ductile phase 30) combined with a ductile phase 32. However, not illustrated in FIGS. 2A to 2C is the "clustering" of cast and/or sintered carbide particles 22, 24. Rather, discrete bodies 40 formed with such clusters 26 are shown, for example, in FIGS. 3C, 4C, and 5C. Clusters 26 are integrally bridged carbide particles, wherein the clusters or integrally bridged carbide particles have an irregular morphology, specifically a generally nodular particle morphology as a result of the bridging between the plurality of individual carbide particles (which fuse or integrally join the particles together). For these nodular clusters, the morphology may also be described by the morphology of primary particles that when fused form the nodular structure. The primary carbide particles may take various shapes such as spherical or angular shapes. Depending on the surface geometry, size, and packing density of the primary particles, upon fusing there may be voids or pores present within the structure. These voids or pores may be filled by a binder metal during subsequent processes.

Thus, as illustrated in FIGS. 3C, 4C, and 5C, clusters or integrally bridged 26 cast tungsten carbide particles 22 (shown in FIG. 3C), sintered tungsten carbide particles 24 (shown in FIG. 4C), or combinations of both (shown in FIG. 5C) may be combined with a ductile metal binder phase 30 and sintered to form discrete bodies or regions 40. Discrete bodies or regions 40 may then be used with a second ductile metal binder phase 32 to form composite material 50.

While FIGS. 3C, 4C, and 5C show the clusters 26 formed (with a ductile phase) into discrete bodies or regions 40, which are then combined with a second ductile phase to form a composite material 50, the present disclosure is not so limited. Rather, the formation of and resulting composite material 42 of clusters 26 with ductile metal phase 30, as illustrated in FIGS. 3A-B, 4A-B, and 5A-B, is also within the scope of the present disclosure. For example, as shown in FIGS. 3A-B, 4A-B, and 5A-B, clusters or integrally bridged 26 cast tungsten carbide particles 22 (shown in FIG. 3A-B), sintered tungsten carbide particles 24 (shown in FIG. 4A-B), or combinations of both (shown in FIG. 5A-B) may be combined with a ductile metal binder phase 30 and sintered to form a composite material 42. Composite material 42 may be representative of any downhole cutting tool component, including hardfacing, cutting elements, bit bodies, etc. Further, as shown in 3B, 4B, and 5B, specifically, the composite material 42 may be a pellet, which may then be used as a component (to form different composites, for example) for a variety of applications as well. Further, while FIGS. 3A, 3C, 5A, and 5C show the use of spherical cast carbides, it is specifically within the scope of the present disclosure that angular cast carbides may be used. Thus, it should be clear that in accordance with the present disclosure, various composite materials may include clusters of cast carbides (angular or spherical), sintered carbides (angular or spherical), or combinations thereof.

Figure 6A:
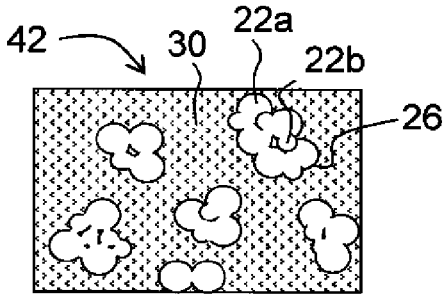
FIGS. 6A and 6B illustrate composite materials of the present disclosure that use differently size primary carbide particles.
Figure 6B:
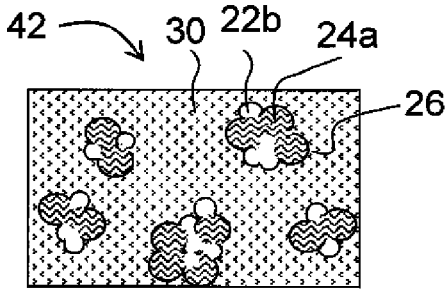
Figure 7A:
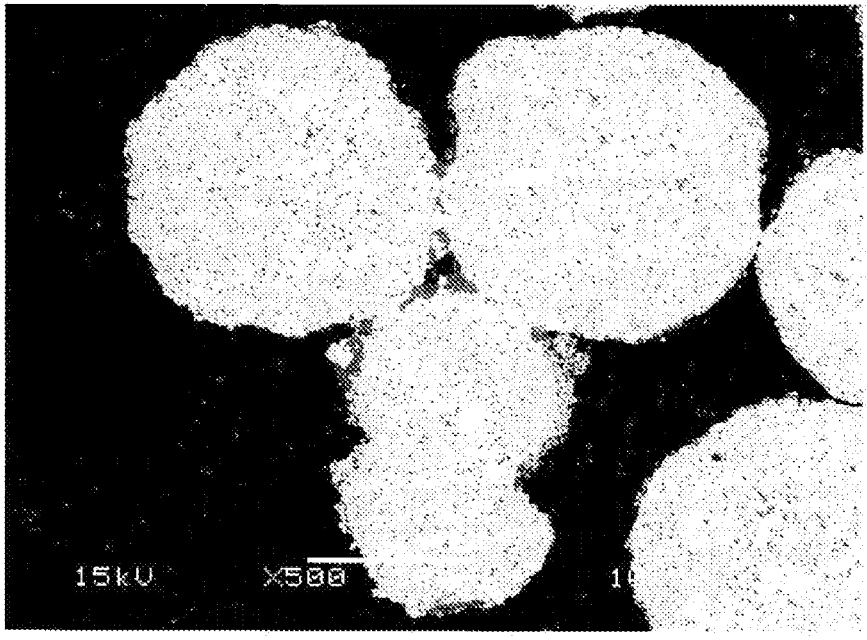
FIGS. 7A to 7D illustrate scanning electron microscope images of some embodiments of the present disclosure.
Figure 7B:
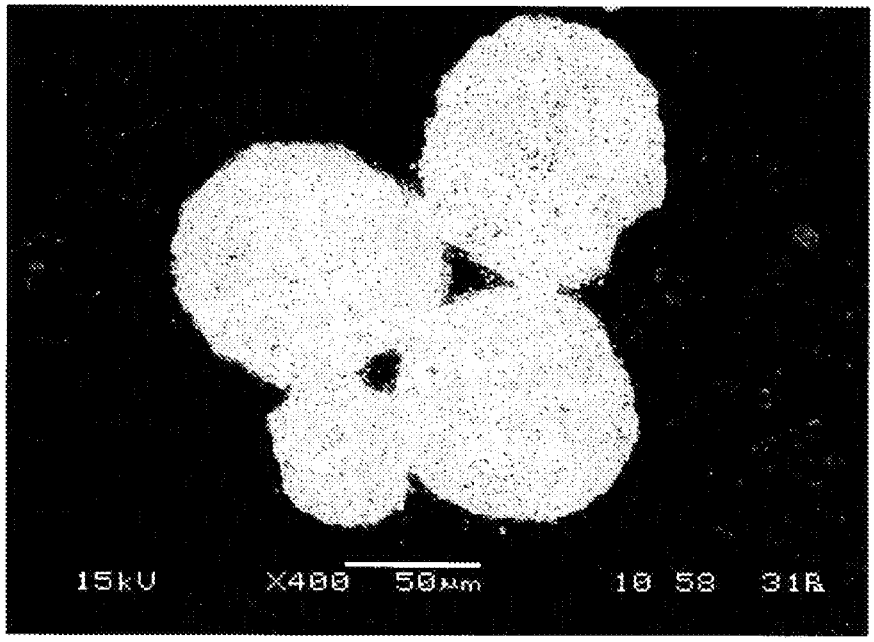
Figure 7C:
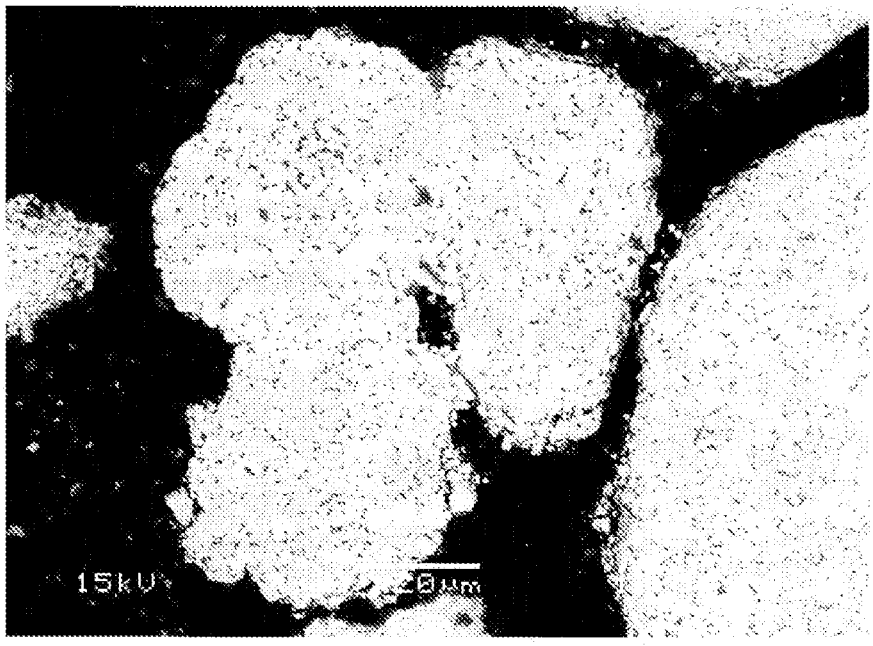
Figure 7D:
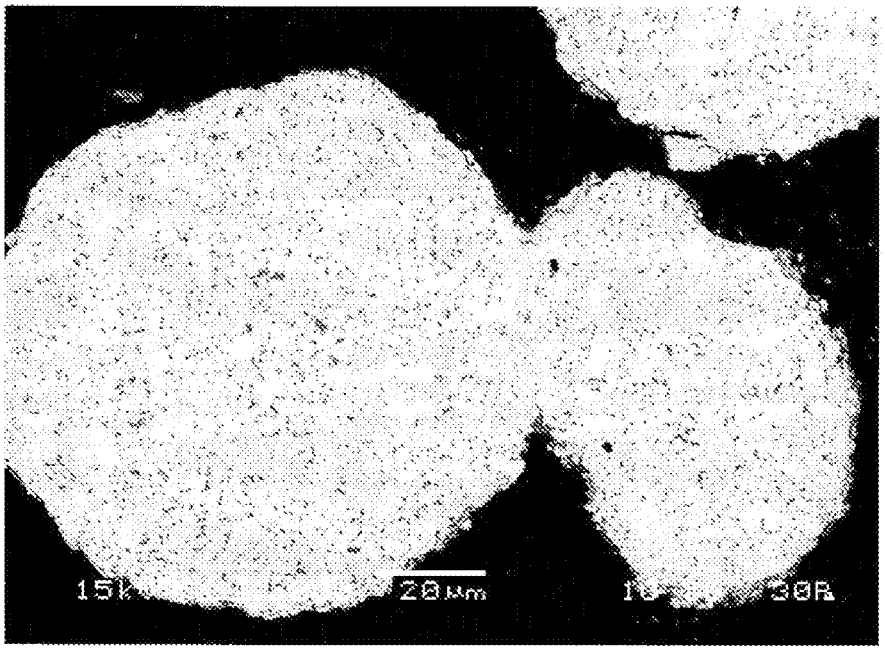

Further, while FIGS. 2A-5C show use of primary carbide particles of substantially the same size, the present disclosure is not so limited. Rather, it is specifically within the scope of the present disclosure that a range of primary particle sizes may be used. Such a variation is shown, for example, in FIGS. 6A and 6B. As shown in FIG. 6A, cast carbide particles 22*a* are combined and joined together with cast carbide particles 22*b* of a smaller particle size than particles 22*a* to form clusters or integrally bridged 26 particles. Further, as shown in FIG. 6B, sintered carbide particles 24*a* are combined and joined together with cast carbide particles 22*b* of a smaller particle size than particles 24*a* to form clusters or integrally bridged 26 particles. Additionally, while only two variations are shown, one skilled in the art would appreciate that there are several other variations/combinations of particle type and relative particle size that are also within the scope of the present disclosure.

Cast tungsten carbide particles are generally available in particle sizes greater than 15 microns, and sintered tungsten carbide particles are generally available in particle sizes greater than 50 microns. Thus, in various embodiments, the primary carbide particles used to form any of the composite materials described above (i.e., the embodiments shown in FIGS. 2A-6B) may range in size from about 15 or 50 microns to 1500 microns, from about 15 microns to 500 microns for cast carbide particles (preferably 40 to 350 microns) and from about 50 to 1500 microns for sintered carbide particles (preferably 60 to 800 microns) in particular embodiments. However, selection of the particular particle size of the primary particles may depend, for example, on 1) whether the particles are being formed into clusters and 2) if being formed into clusters, whether the clusters are being pelletized with a binder for use in the final application or whether the clusters are being directly used with a binder in the final application; and whether any relative size difference between particles is desired. When a plurality of primary particles are combined and fused together to form clusters, the size of the clusters (in at least one dimension) may range, for example, from 40 microns to 5000 microns and from 100 to 4000 microns in a particular embodiment. In other particular embodiments, the clusters (in at least one dimension) may range from 100 to 1500 microns for cast carbide clusters, 250 to 4000 microns for cemented carbide clusters, and 200 to 3000 microns for clusters having a mixture of cast and cemented carbides. Sintered pellets having cast and/or cemented carbide particles dispersed therein (either non-conjoined or conjoined) may range from 50 microns to 6000 microns, and from 200 to 5000 microns in a particular embodiment. Selection of the particular cluster and/or pellet size may depend, for example, on 1) the particle size and number of particles forming the cluster, 2) whether the clusters are being formed into pellets, or 3) whether the pellets are formed of clustered or dispersed primary particles. Further, while these exemplary ranges are listed, there may be other instances where smaller or larger sizes may be preferred.

As shown in each of FIGS. 3A to 6B, there exist a broad range of numbers of particles 22 and/or 24 that may be combined to form clusters 26. Rather, while there exists a lower limit of two particles that must be joined to form a cluster, there exists no upper limit. However, in particular embodiments, this number may range from 2 to 50.

The various embodiments described above are all directed to the use of sintered and/or cast tungsten carbide as the primary particle type. A brief discussion of each follows. Sintered tungsten carbide (also known as cemented tungsten carbide) is a material formed by mixing particles of tungsten carbide, typically monotungsten carbide, and cobalt particles, and sintering the mixture. Methods of manufacturing cemented tungsten carbide are disclosed, for example, in U.S. Pat. Nos. 5,541,006 and 6,908,688, which are herein incorporated by reference. Sintered tungsten carbide is commercially available in two basic forms: crushed and spherical (or pelletized). Crushed sintered tungsten carbide is produced by crushing sintered components into finer particles, resulting in more irregular and angular shapes, whereas pelletized sintered tungsten carbide is generally rounded or spherical in shape.

Briefly, in a typical process for making sintered tungsten carbide, a tungsten carbide powder having a predetermined size (or within a selected size range) is mixed with a suitable quantity of cobalt, nickel, or other suitable binder. The mixture is typically prepared for sintering by either of two techniques: it may be pressed into solid bodies often referred to as green compacts, or alternatively, the mixture may be formed into granules or pellets such as by pressing through a screen, or tumbling and then screened to obtain more or less uniform pellet size. Such green compacts or pellets are then heated in a controlled atmosphere furnace to a temperature near the melting point of cobalt (or the like) to cause the tungsten carbide particles to be bonded together by the metallic phase. Sintering globules of tungsten carbide specifically yields spherical sintered tungsten carbide. Crushed cemented tungsten carbide may further be formed from the compact bodies or by crushing sintered pellets or by forming irregular shaped solid bodies.

The particle size and quality of the sintered tungsten carbide can be tailored by varying the initial particle size of tungsten carbide and cobalt, controlling the pellet size, adjusting the sintering time and temperature, and/or repeated crushing larger cemented carbides into smaller pieces until a desired size is obtained. In one embodiment, tungsten carbide particles (unsintered) having an average particle size of between about 0.2 μm to about 20 μm are sintered with cobalt to form either spherical or crushed cemented tungsten carbide. In a preferred embodiment, the cemented tungsten carbide is formed from tungsten carbide particles having an average particle size of about 0.8 μm to about 5 μm. In some embodiments, the amount of cobalt present in the cemented tungsten carbide is such that the cemented carbide is comprised of from about 6 to 8 weight percent cobalt.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC drips. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a hardfacing or matrix typically has a hypoeutectic carbon content of about 4 weight percent. In one embodiment of the present disclosure, the cast tungsten carbide used in the mixture of tungsten carbides is comprised of from about 3.7 to about 4.2 weight percent carbon.

The embodiments described above describe the use of cast and sintered tungsten carbide either being used independently or in combination in formation of the composite materials of the present disclosure. Selection between cast tungsten carbide, sintered tungsten carbide, or the combination of both may be made to provide a bit (or tool component) that is tailored for a particular drilling or other cutting application. For example, the type, shape, and/or size of carbide particles used in the formation of a matrix bit body may affect the material properties of the formed bit body, including, for example, fracture toughness, transverse rupture strength, and erosion resistance.

In addition to cast tungsten carbide (mixture of $W_2C$ and WC) and/or sintered tungsten carbide (WC—Co), it is also within the scope of the present disclosure that macrocrystalline tungsten carbide or monotungsten carbide (WC) particles may be an optional particle type also included in the composite materials (apart from the use of WC to form sintered tungsten carbide). For example, referring to FIGS. 2A to 5C and 6A&B, in an alternative embodiment, monotungsten carbide may be dispersed in ductile phase 30 or second ductile phase 32 (where present). Similarly, it is also within the scope of the present disclosure that ductile phase 30 (in the embodiments shown in FIGS. 3A to 5C and 6A&B) may have dispersed (non-clustered) particles of cast and/or sintered tungsten carbide used in combination with the clustered particles and/or that second ductile phase 32 (in 2A-C, 3C, 4C, and 5C) could also have additional dispersed (non-clustered) and/or clustered particles of cast and/or sintered tungsten carbide used in combination with the sintered pellets.

Further, ductile region 30 and second ductile region 32 may have the same or different metal content (including relative amount and composition). Various metal materials that may be present in the ductile phase include all transition metals, main group metals and alloys thereof, such as cobalt, nickel, iron, copper, manganese, titanium, aluminum, tantalum, molybdenum, niobium, tungsten, vanadium, and combinations thereof, which may serve as a primary alloying element (s). Aluminum, manganese, chromium, zinc, tin, silicon, silver, boron, and lead, for example, may also be present in the binder.

Selection of the metal for each metal phase may depend on such factors as the particular application of the composite material, the number of ductile phases, the desired properties, etc. For example, in a hardfacing, the ductile region (outermost ductile region, if more than one ductile regions exist) may include a iron or nickel based alloy; in matrix bit bodies, copper, nickel, iron, cobalt, or alloys thereof; and in cemented bodies such as cutting elements, cobalt, nickel, or iron. When more than ductile region exists, the inner ductile region (forming the discrete body) may be selected based on the desired properties of sintered pellets or bodies, but may often include cobalt, nickel, iron, and/or alloys thereof.

Relative content between carbide portions (particles, clusters or pellets) and the metal binder may range from 40 to 95 percent by weight carbide, greatly dependent on the type of application. For example, in hardfacings, the carbide content may range from about 40 to 75 percent, whereas cutting elements may include 80 to 95 percent by weight carbide.

For embodiments which use sintered tungsten carbide, there may also be some selection of the metal content to form the sintered particle itself. For example, the relative ductile phase content (and type) by which sintered particles are surrounded may be selected to be greater or less than (or different from) the metal content in the sintered particle itself. Similarly, for embodiments which include monotungsten carbide particles dispersed in the ductile phase, the amount and/or particle size of the monotungsten carbide particles may be selected to be greater or less than the monotungsten carbide particles used to form the primary sintered carbide particles In embodiments that use clusters (integrally joined primary particles of cast and/or sintered tungsten carbide), the primary particles may be integrally joined through a sintering process. The primary particles may be agglomerated (loosely associated) through particle blending with a metal binder powder, monotungsten carbide particles, and/or an organic binder power. The agglomerates may optionally be granulated into desired agglomerate sizes prior to sintering. Upon sintering, the particles may fuse together. When using sintered tungsten carbide particles, it may be possible that the binder present in the sintered carbide particle itself serve to join the particles together.

In one embodiment, powders of WC (0.5-10 micron), Co (cobalt), and cast tungsten carbide (15-500 micron) may be mixed and the mixture sintered in either vacuum, an inner gas atmosphere or under hot isostatic pressing (HIP). The sintered product may optionally be crushed and the composite particles with desired size screened out.

In another embodiment, powders of WC (0.5-10 micron), Co, and cast tungsten carbide (15-500 micron) may be mixed using a granulator to produce pre-sintered pellets. The mixture may be sintered in either vacuum, an inner gas atmosphere or under HIP, the sintering produces sintered carbide pellets having cast carbide (and WC) formed therein.

In yet another embodiment, powders of sintered tungsten carbide WC—Co (50-1500 micron) pellets and cast tungsten carbides (15-500 micron) with or without addition of small quantity of Co may be mixed (optionally with a granulator). The mixture may be sintered in either vacuum, an inner gas atmosphere or under HIP. The cobalt in the WC—Co pellets or/and the added Co powder may serve to bond the sintered and cast tungsten carbides together. The sintered product may optionally be crushed and the composite particles with desired size screened out.

Referring to FIGS. 7A-D, scanning electron microscope images of four sample embodiments of the present disclosure are shown. As shown in FIGS. 7A-D, a plurality of sintered carbide particles have been integrally joined together to form a cluster of primary particles, the cluster having an irregular, nodular morphology.

Figure 8:
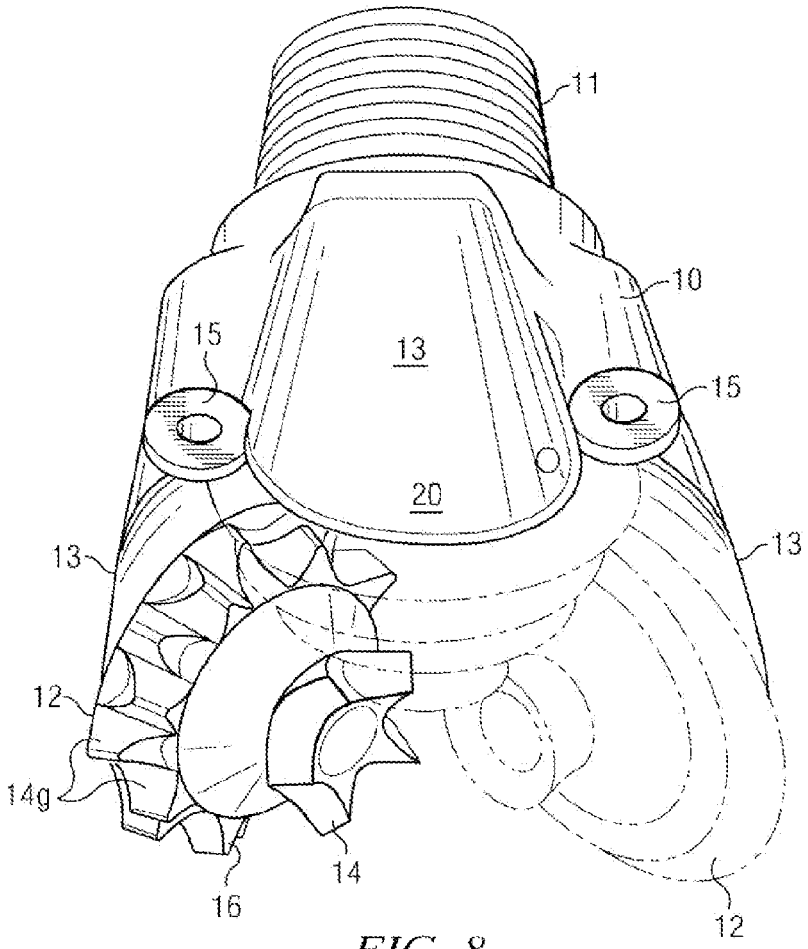
FIG. 8 illustrates a roller cone drill bit that incorporates the composite materials of the present disclosure.

As discussed above, the composite materials of the present disclosure may find particular use as hardfacings including hardfacings of milled teeth and shirttail of the leg back of roller cone bits, hardfacing of PDC bit bodies for erosion protection and other hardfacings in downhole drilling facilities, but may also be used in other applications, including other downhole cutting tool applications such as cutting elements and bit bodies. Referring to FIG. 8, an example of a milled tooth roller cone drill bit is shown. As shown, the bit includes a steel body 10 having a threaded coupling ("pin") 11 at one end for connection to a conventional drill string (not shown). At the opposite end of the drill bit body 10 are three roller cones 12, for drilling earth formations. Each of the roller cones 12 is rotatably mounted on a journal pin (not shown in FIG. 8) extending diagonally inwardly on each one of the three legs 13 extending downwardly from the bit body 10. Each leg 13 has a shirttail portion (region) 20. As the bit is rotated by the drill string (not shown) to which it is attached, the roller cones 12 effectively roll on the bottom of the wellbore being drilled. The roller cones 12 are shaped and mounted so that as they roll, teeth 14 on the cones 12 gouge, chip, crush, abrade, and/or erode the earth formations (not shown) at the bottom of the wellbore. The teeth 14G in the row around the heel of the cone 12 are referred to as the "gage row" teeth. They engage the bottom of the hole being drilled near its perimeter or "gage." Fluid nozzles 15 direct drilling fluid ("mud") into the hole to carry away the particles of formation created by the drilling.

Figure 10:
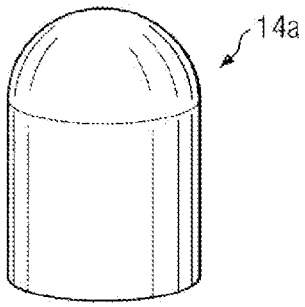
FIG. 10 illustrates an insert that may be formed with the composite materials of the present disclosure.

Such a roller cone rock bit as shown in FIG. 8 is conventional for a milled tooth bit and is therefore merely one example of various arrangements that may be used in a rock bit in accordance with the present disclosure. For example, most roller cone rock bits have three roller cones as illustrated in FIG. 8. However, one, two and four roller cone drill bits are also known in the art. Therefore, the number of such roller cones on a drill bit is not intended to be a limitation on the scope of the present disclosure. In addition, embodiments of the present disclosure apply equally well to TCI (tungsten carbide insert) roller cone bits (having a sintered tungsten carbide insert 14*a* shown in FIG. 10 inserted into holes in cone 12 instead of teeth 14 formed integrally therewith) or drag bits.

The arrangement of the teeth 14 on the cones 12 shown in FIG. 8 is just one of many possible variations. In fact, it is typical that the teeth on the three cones on a rock bit differ from each other so that different portions of the bottom of the hole are engaged by each of the three roller cones so that collectively the entire bottom of the hole is drilled. A broad variety of tooth and cone geometries are known and do not form a specific part of this present disclosure, nor should the present disclosure be limited in scope by any such arrangement.

In addition, while embodiments of the present disclosure describe hardfacing teeth, embodiments of the present disclosure may be used to provide erosion, abrasion, or wear protection for shirttails of all types of roller cone bits, fixed cutter bits, or other types of bits (mining bits) or downhole tools (reamers, stabilizers, etc.) as known in the art. The specific descriptions provided below do not limit the scope of the present disclosure, but rather provide illustrative examples. Those having ordinary skill in the art will appreciate that the hardfacing composites may be used on other types of and locations on drill bits and earth boring cutting tools.

Figure 9:
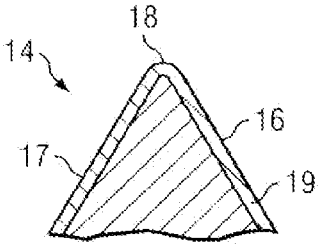
FIG. 9 illustrates a tooth coated with the composite materials of the present disclosure.

The example teeth on the roller cones shown in FIG. 8 are generally triangular in a cross-section taken in a radial plane of the cone. Referring to FIG. 9, such a tooth 14 has a leading flank 16 and a trailing flank 17 (determined by the direction of rotation of the bit and/or cone) meeting in an elongated crest 18. The flank 16, 17, and crest 18 of the tooth 14 are covered with a hardfacing layer 19. Sometimes only the crest and leading face of each such tooth 14 is covered with a hardfacing layer 19 so that differential erosion, abrasion, or wear between the wear-resistant hardfacing on the front flank of a tooth and the less wear-resistant steel on the trailing face of the tooth may keep the crest of the tooth relatively sharp for enhanced penetration of the rock being drilled. In other cases, particularly near the axis of the bit, neither flank can be uniformly regarded as the leading flank, and both flanks may be provided with hardfacing.

Thus, according to embodiments of the present disclosure clusters of cast and/or sintered carbide particles and/or sintered pellets of cast and/or sintered carbide particles (clustered or unjoined/dispersed) may be applied as a hardfacing as a filler in a steel tube or other metal alloy such as a nickel alloy. The hardfacing filler materials may further comprise deoxidizer and resin. When the pellets and/or clusters are applied to drill bits, particles may be dispersed in a matrix of alloy welded to the drill bits.

Application of the composites disclosed herein may be achieved by any suitable method known in the art. Embodiments of the present disclosure may use any suitable hardfacing technique(s) known in the art to achieve hardfacing composition variations. Prior art methods that may be used with embodiments of the present disclosure, for example, may include atomic hydrogen welding, oxyacetylene welding, plasma transfer arc ("PTA"), pulsed plasma transfer arc ("PPTA"), gas tungsten arc, shielded metal arc process, laser cladding, d-gun, spray-and-fuse, or high velocity cold spray technique or the like.

Further, as stated above, embodiments of the present disclosure apply equally well to fixed cutter bits as to roller cone bits. For example, FIG. 11 shows a drill bit body 90 comprising at least one PDC cutter 100. The drill bit body 90 is formed with at least one blade 91, which extends radially from a central longitudinal axis 95 of the drill bit 90. Bit body 90 may include steel bit bodies, which have conventionally have hardfacing applied thereto, as well as matrix bit bodies, such as described in U.S. Patent Application Publication No. 2008/0164070A1, filed on Jan. 8, 2007, which is assigned to the present assignee and herein incorporated by reference in its entirety.

In the present embodiment, the bit body 90 includes a hardfacing layer 120, which includes an abrasive phase formed from abrasive particles and a binder alloy. As with the above, the hardfacing layer 120 may be applied using any technique known in the art, such as "tube," thermal spray, or arc hardfacing. The PDC cutter 100 is disposed on the blade 91.

The PDC cutter 100 may be formed (as shown in FIG. 12) from a polycrystalline diamond compact 102 and a sintered tungsten carbide composite substrate 104, among other materials. The polycrystalline diamond compact and the sintered tungsten carbide substrate may be bonded together using any method known in the art.

In addition to the composite materials of the present disclosure being used as a hardfacing material on a drill bit, as described above, it is also within the scope of the present disclosure that the composite materials may be used, for example, to form sintered tungsten carbide insert 14*a* (shown in FIG. 10) or sintered tungsten carbide substrate 104 (shown in FIG. 12). Moreover, it is also within the scope of the present disclosure that bit body 90 may be formed with these composite materials as well.

Embodiments of the present disclosure may provide for at least one of the following advantages: reducing cast carbide sinking and grouping during welding by integrating sintered and cast carbides and/or reducing dissolution rate. For the latter case, the clusters or the composite pellets may protect those sintered carbides staying inside them and the carbide surfaces facing inward from contacting directly to the Fe based alloy binder, therefore, from Fe dissolution. Because the use of clusters and/or pellets may provide for a more a uniform distribution of the cast carbides particles throughout the entire hardfacing layer depth, including near the surface, and/or lower dissolution, better wear resistance properties may result without losing material toughness. By allowing for the combination and integration of sintered carbides (which provide greater toughness) and cast carbides (which provide greater wear resistance) into a single composite material, hardness/wear resistance and toughness may be integrated and provided through a single material.

While the present disclosure has been described with respect to a limited number of embodiments, those skilled in the art, having benefit of this disclosure, will appreciate that other embodiments can be devised which do not depart from the scope of the present disclosure as disclosed herein. Accordingly, the scope of the invention should be limited only by the attached claims.

What is claimed:

1. A carbide composite material comprising:

a continuous ductile phase; and at least one discrete carbide region surrounded by the continuous ductile phase, the at least one discrete carbide region comprising an integrally bridged plurality of carbide particles selected from at least one of cast carbide or sintered carbide, wherein the integrally bridged plurality of carbide particles comprise carbide particles that are integrally fused together to form direct carbide particle to carbide particle bonding, and wherein the at least one discrete region has a nodular particle morphology.

2. The carbide composite material of claim 1, further comprising a plurality of discrete second carbide particles dispersed in continuous ductile phase.

3. The carbide composite material of claim 2, wherein the second carbide particles comprise at least one selected from the group consisting of cast carbide particles, sintered carbide particles, and macrocrystalline carbide particles.

4. The carbide composite material of claim 1, wherein the plurality of carbide particles selected from at least one of cast carbide or sintered carbide range in size from 20 to 1500 microns.

5. The carbide composite material of claim 4, wherein the plurality of cast carbide particles range in size from 40 to 350 microns, and the plurality of sintered carbide particles range in size from 60 to 800 microns.

6. The carbide composite material of claim 1, wherein the at east one discrete region ranges in size from 40 to 5000 microns.

7. The carbide composite material of claim 6, wherein the at least one discrete region comprises the integrally bridged plurality of cast carbide particles, the at least one discrete region ranging in size from about 100 to 1500 microns.

8. The carbide composite material of claim 6, wherein the at least one discrete region comprises the integrally bridged plurality of sintered carbide particles, the at least one discrete region ranging in size from about 250 to 4000 microns.

9. The carbide composite material of claim 6, wherein the at least one discrete region comprises the integrally bridged plurality of cast and sintered carbide particles, the at least one discrete region ranging in size from about 200 to 3000 microns.

10. A drill bit comprising:

a bit body;

at least one cutting element; and a hardfacing comprising the carbide composite material of claim 1 disposed on at least an exterior portion of the drill bit.

11. The drill bit of claim 10, further comprising:

at least one roller cone rotatably mounted to the bit body, the at least one roller cone having the at least one cutting element attached thereto, wherein hardfacing is disposed on at least one of the at least one roller cone or the at least one cutting element.

12. The drill bit of claim 10, further comprising:

at least one blade extending from the bit body; and at least one cutter pocket disposed on the at least one blade, wherein the at least one cutting element is disposed in the at least one cutter pocket, and wherein the hardfacing is disposed on at least an exterior surface of the bit body.

13. The drill bit of claim 10, wherein the hardfacing is deposited on at least one of a shirttail of a roller cone bit leg.

14. A drill bit comprising:

a bit body; and at least one cutting element, wherein the bit body comprises the carbide composite material of claim 1.

15. A drill bit comprising:

a bit body; and at least one cutting element comprising the carbide composite material of claim 1.

16. A carbide composite material comprising:

a first continuous ductile phase; and a plurality of first discrete regions surrounded by the first continuous ductile phase, each first discrete region comprising:

a second continuous ductile phase; and at least one second discrete carbide region surrounded by the second continuous ductile phase, the at least one second discrete carbide region comprising an integrally bridged plurality of carbide particles selected from at least one of cast carbide or sintered carbide, wherein the integrally bridged plurality of carbide particles comprise carbide particles that are integrally fused together to form direct carbide particle to carbide particle bonding, and wherein the at least one second discrete carbide region has a nodular particle morphology.

17. The carbide composite material of claim 16, further comprising a plurality of second carbide particles dispersed in the first continuous ductile phase.

18. The carbide composite material of claim 17, wherein the second carbide particles comprise at least one selected from the group consisting of cast carbide particles, sintered carbide particles, and macrocrystalline carbide particles.

19. The carbide composite material of claim 16, wherein each first discrete region further comprises a plurality of discrete third carbide particles dispersed in the second continuous ductile phase.

20. The carbide composite material of claim 19, wherein the third carbide particles comprise at least one selected from the group consisting of cast carbide particles, sintered carbide particles, and macrocrystalline carbide particles.

21. The carbide composite material of claim 16, wherein the at least one second discrete region ranges in size from 40 to 5000 microns.

22. A drill bit comprising:

a bit body;

at least one cutting element; and a hardfacing comprising the carbide composite material of claim 16 disposed on at least an exterior portion of the drill bit.

23. A carbide composite material comprises:

a first continuous ductile phase; and a plurality of first discrete regions surrounded entirely by the first continuous ductile phase, each first discrete region comprising:

a second continuous ductile phase; and a plurality of first carbide particles surrounded by the second continuous ductile phase, the plurality of first carbide particles selected from at least one of cast carbide or sintered carbide, wherein at least two of the plurality of first carbide particles are integrally bridged to form a nodular particle morphology.

24. A drill bit comprising:

a bit body; and at least one cutting element, wherein the bit body comprises the carbide composite material of claim 23.

25. The carbide composite material of claim 23, further comprising a plurality of second carbide particles dispersed in the first continuous ductile phase.

26. The carbide composite material of claim 25, wherein the second carbide particles comprise at least one selected from the group consisting of cast carbide particles, sintered carbide particles, and macrocrystalline carbide particles.

27. The carbide composite material of claim 23, wherein each first discrete region further comprises a plurality of third carbide particles dispersed in the second continuous ductile phase.

28. The carbide composite material of claim 23, wherein the discrete regions range in size from 50 to 6000 microns.

29. A drill bit comprising:

a bit body;

at least one cutting element; and a hard facing comprising the carbide composite material of claim 23 disposed on at least an exterior portion of the drill bit.

30. A drill bit comprising:

a bit body; and at least one cutting element comprising the carbide composite material of claim 23.

* * * * *